United States Patent [19]

Kadleck et al.

[11] Patent Number: 4,890,737

[45] **Date of Patent: * Jan. 2, 1990**

[54] CARDBOARD DISPLAY CONTAINER WITH CONTENTS RETAINING MEANS

[75] Inventors: Richard G. Kadleck, Berea; William W. Nowak, Broadview Heights, both of Ohio

[73] Assignee: The Shelby Paper Box Co., Westlake, Ohio

[ * ] Notice: The portion of the term of this patent subsequent to Apr. 5, 2005 has been disclaimed.

[21] Appl. No.: 274,695

[22] Filed: Nov. 14, 1988

Related U.S. Application Data

[60] Continuation of Ser. No. 140,158, Dec. 31, 1987, abandoned, which is a division of Ser. No. 897,498, Aug. 18, 1986, Pat. No. 4,735,314.

[51] Int. Cl.[4] ..... B65D 85/44

[52] U.S. Cl. ..... 206/427; 206/173; 206/476; 229/40

[58] Field of Search ..... 206/145–147, 206/171–173, 181, 182, 194, 193, 426, 427, 429, 435, 434; 229/40, 41 R, 41 B

[56] References Cited

U.S. PATENT DOCUMENTS

| | | | |
|---|---|---|---|
| D. 207,805 | 5/1967 | Nowak . | |
| D. 211,139 | 5/1968 | Nowak . | |
| 917,177 | 3/1909 | Hilliker . | |
| 2,798,603 | 7/1957 | Grinspoon . | |
| 2,815,857 | 12/1957 | Sester | 229/40 |
| 2,817,473 | 12/1957 | Foster . | |
| 2,823,062 | 2/1958 | Toensmeier . | |
| 3,083,825 | 4/1963 | Larsen . | |
| 3,156,404 | 11/1964 | Wood | 229/40 |
| 3,194,476 | 7/1965 | Weiss . | |
| 3,252,649 | 5/1966 | Graser et al. | 229/40 |
| 3,281,180 | 10/1966 | Sperry . | |
| 3,598,302 | 8/1971 | Nowak . | |
| 3,854,580 | 12/1974 | Hennessey | 206/426 |
| 3,884,353 | 5/1975 | Forte | 206/426 |
| 4,381,057 | 4/1983 | Carver | 206/426 |
| 4,637,515 | 1/1987 | Wilson et al. | 206/434 |
| 4,640,417 | 2/1987 | Durand | 206/426 |
| 4,681,217 | 7/1987 | Hernandez | 206/141 |

FOREIGN PATENT DOCUMENTS

| | | |
|---|---|---|
| 89608 | 7/1967 | France . |
| 448871 | 4/1968 | Switzerland . |
| 890068 | 2/1962 | United Kingdom . |
| 917670 | 2/1963 | United Kingdom . |

*Primary Examiner*—Bryon P. Gehman
*Attorney, Agent, or Firm*—Body, Vickers & Daniels

[57] ABSTRACT

A carton is disclosed for containing and displaying cylindrical objects such as drinking glasses or canned goods, and a single foldable paperboard blank form is disclosed for making the carton. The carton is in the form of an open ended sleeve having a divider panel providing adjacent sections for receiving the cylindrical objects, and folding tab members interengaged with the divider panel to retain the objects within the open ends while providing maximum visible exposure of the objects at the carton sides and ends. Tabs in the top and bottom panels of the carton provide finger holes for carrying the carton and extend into the carton transverse to the divider panel and between adjacent objects in the direction between the open ends of the sleeve.

3 Claims, 3 Drawing Sheets

FIG. 4
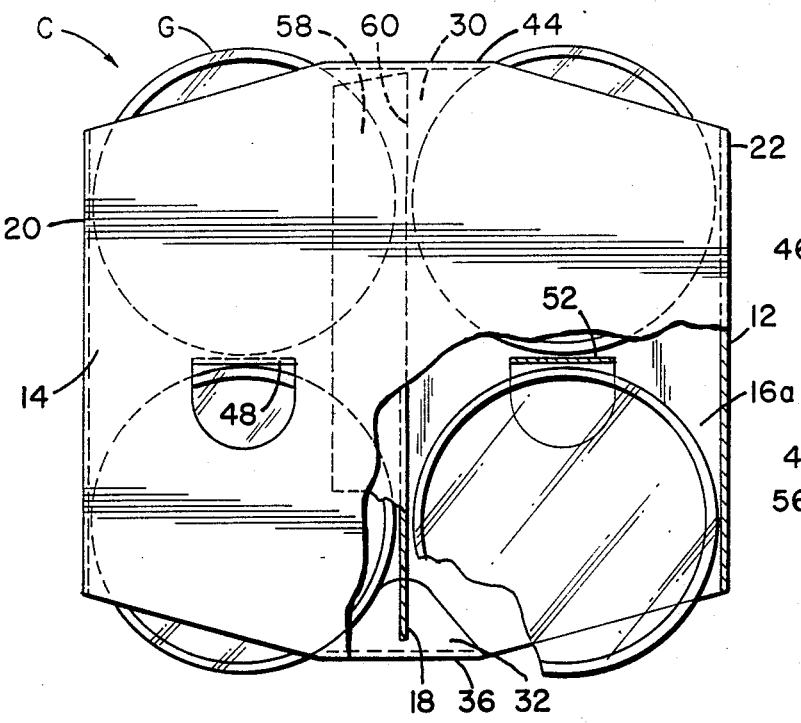
FIG. 3
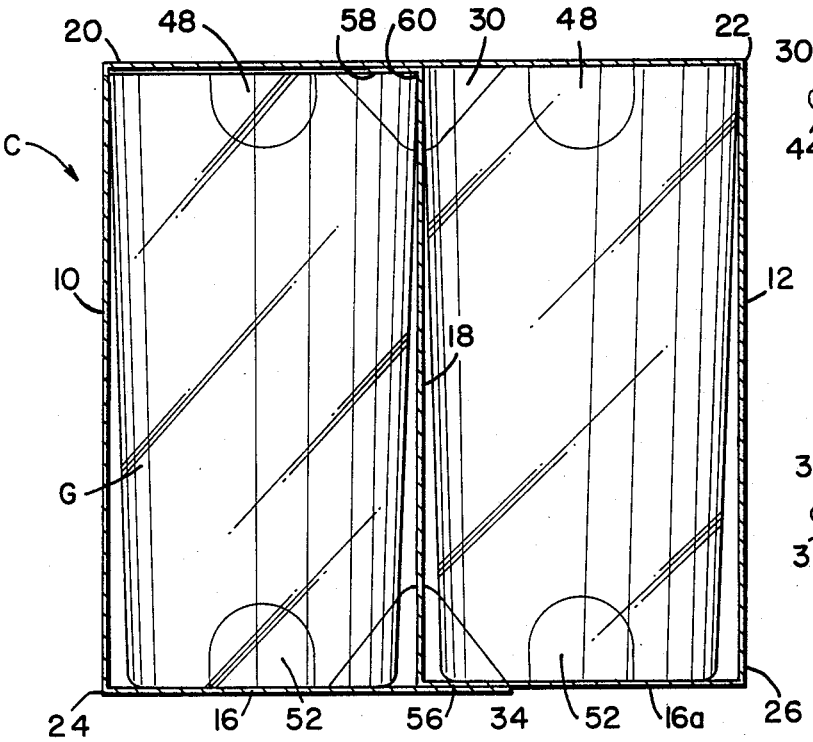
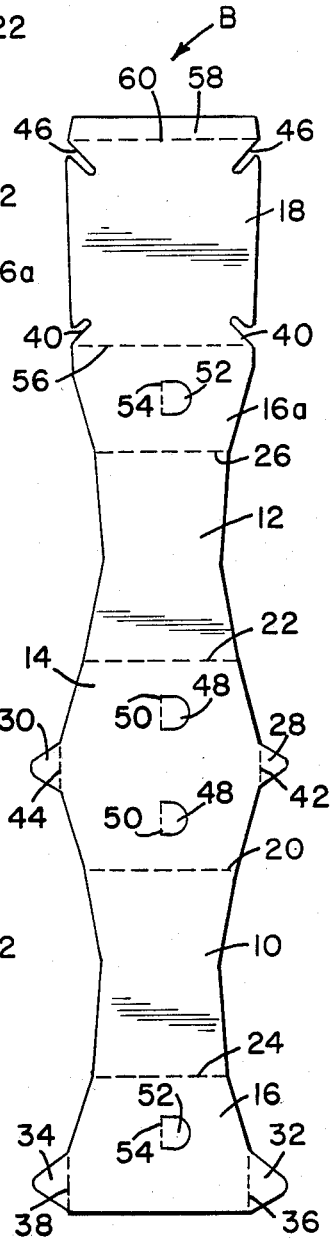
FIG. 5

CARDBOARD DISPLAY CONTAINER WITH CONTENTS RETAINING MEANS

The present invention pertains to the art of paperboard packaging, and more particularly to a carton for carrying and displaying generally cylindrical objects such as drinking tumblers.

BACKGROUND OF THE INVENTION

Drinking tumblers, canned goods, or other cylindrical objects are commonly packaged in folded paperboard cartons for display and sale to retail consumers. Such cartons typically consist of a closed sleeve with foldable portions disposed to retain the tumblers or cans in a generally rectangular array of four, six or more. The closed sleeves are formed by folding an elongated paperboard blank to encircle the array of items on four sides, leaving two opposite ends open and various arrangements are employed to retain the objects within the open ends of the sleeve. For example, folded flaps may engage recessed portions of the objects, or may encircle them at one or both ends. One of such former arrangements is disclosed in Foster U.S. Pat. No. 2,817,473 and one of the latter arrangements is disclosed in Nowak U.S. Pat. No. 3,598,302. These patents are generally illustrative of the prior art and are incorporated herein by reference.

A particular disadvantage inherent in these and other prior art cartons is the substantially complete coverage of the sides of the articles by the folded sleeve, whereby the consumer's view of the contained items is undesirably obstructed and basically limited to the two open ends of the carton. This limited view may further be obstructed by folded locking flaps disposed within the open portions of the carton and about portions of the ends of the articles, as seen in the above-referenced patent to Nowak. Further, the articles in the latter patent are spaced apart by the locking flap portions extending therebetween, resulting in an inefficient increase in overall package size.

Other disadvantages of prior art cartons result from the paperboard blanks from which the cartons are formed. For example, the blanks must be cut and scored to provide appropriate and accurately folded positioning of the sleeve panels and locking flaps to position and retain the articles in the container. This requires precision cutting and involves particular complexity with respect to the flaps when the latter must be formed to fit within recessed portions of the objects contained in the carton. More particularly, such arrangements require the blank to be cut precisely for the contour of the flaps to conform to the contour of the objects such as, for example, the inside contours of the closed ends of cans as disclosed in the above-identified patent to Foster. In addition to the curvature limitation, these flaps cannot lockingly engage an open ended object such as a tumbler, shown in the above mentioned patent to Nowak, whereby locking flaps which encircle such open ended objects have been used to maintain the objects in the carton. Such encircling flaps add greater complexity to the carton blank, as these are generally disposed angularly to the objects and thus take an elliptical form. Additionally, waste is caused by cutting out these forms to accommodate the cross section of the cylinders and, as mentioned above, such flaps obscure visibility of the objects in the carton.

A central panel is commonly provided in cartons for dividing the interior thereof, to enhance visibility of the interior, for locking engagement with the folded locking tabs and/or to serve as a reinforcing brace for the sleeve. Generally, such central panels are cut as interior segments of the sleeve panels. This imparts further complexity to the cutting and scoring requirements for the blank and, while supporting the carton vertically, adds the disadvantage of weakening the carton across the panel from which the bracing portion is cut and removed.

SUMMARY OF THE INVENTION

The disadvantages discussed above and others are overcome by the present invention which is directed toward an improved folded paperboard carton for carrying and displaying cylindrical objects, and an improved paperboard blank for making the carton.

In accordance with one aspect of the present invention, there is provided a folded, open ended paperboard carton with four side panels which encircle a rectangular array of cylindrical objects. Folded locking tabs much smaller than heretofore required, secure the objects within the two open ends of the carton while providing maximum visible exposure of the objects at the open ends. A central panel is provided to divide the carton into separate sections, to maintain the articles against direct contact, to provide a locking component for the locking tabs, and further to provide vertical support for the carton. The central panel is formed independently of the side panels and, thus, provides vertical reinforcement without reducing the rigidity of the carton. Advantageously, the locking tabs secure adjacent contained objects without extending between to the extent that they are spaced apart.

In accordance with another aspect of the present invention, there is provided a folded carton with side panels narrower than the sides of the rectangular array of objects to be contained, thereby providing maximum visible exposure of the contained objects at the sides and top as well as at the open ends. In accordance with yet another aspect of the invention, folding tab portions are provided in the top panel of the carton to provide both finger carrying holes in the carton when folded inwardly from the panel and protective spacers which extend between adjacent objects transverse to the central panel, whereby the objects are prevented from direct contact in the direction parallel to the central panel.

In accordance with another aspect of the present invention, there is provided a foldable paperboard blank from which a carton can be quickly and easily erected to provide all the above described carton features and in which blank the panels are in a lineal sequence connected by the means of scored folding lines, and are devoid of major interior cut out lines and devoid of cut out interior portions which structurally weaken the erected carton.

The principal object of the present invention is to provide an improved folded paperboard carton for securely containing cylindrical objects and providing maximum visible exposure of said objects.

Another object of the invention is to provide a folded carton which accommodates cylindrical objects in a tightly packed array to occupy a minimum of space.

A further object of the invention is to provide a folded carton having locking tab portions which are easy to fold into and out of locking engagement and which securely hold the articles in place while promoting maximum visibility thereof.

Still a further object of the invention is to provide a folded paperboard carton of optimum strength and rigidity.

Another object of the invention is to provide a folded carton which includes protective spacer elements between adjacent contained objects.

Yet another object of the invention is to provide a foldable paperboard carton blank form which is of minimal complexity and which is economically produced and easily and readily erected to form a container for cylindrical articles.

BRIEF DESCRIPTION OF THE DRAWINGS

The invention may take physical form in certain parts and arrangements of parts, preferred embodiments of which will be described in detail in this specification and are illustrated in the accompanying drawings which form a part hereof and wherein:

FIG. 3 is a cross sectional elevation view taken along line 3—3 in FIG. 1;

FIG. 4 is a top plan view of the carton;

FIG. 5 is a plan view of the blank used to form the carton shown in FIGS. 1–4.

DESCRIPTION OF A PREFERRED EMBODIMENT

Figure 1:
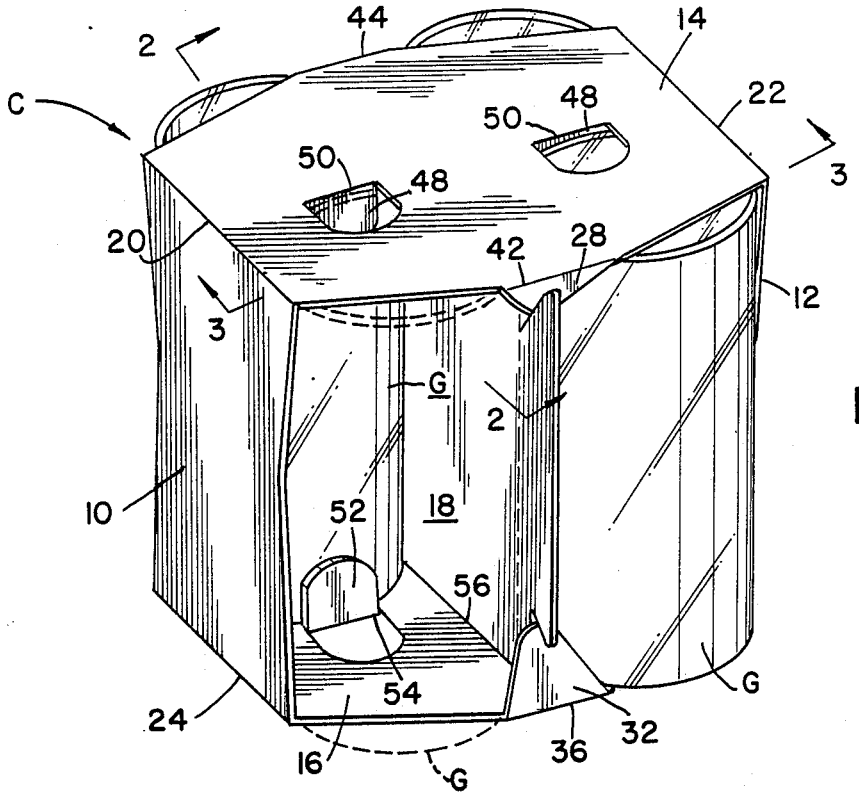
FIG. 1 is a perspective view of a carton according to the present invention and containing a plurality of cylindrical objects.

Referring now to the drawings wherein the showings are for the purpose of illustrating a preferred embodiment of the invention only and not for the purpose of limiting the invention, a carton C according to the invention is shown in FIGS. 1–4 holding a group of four cylindrical objects shown as drinking glasses G. A paperboard blank B, shown in FIG. 5, is erected as described hereinafter to form carton C and has component parts which, when erected provide carton C with two vertical side panels 10 and 12, a top panel 14, a bottom panel defined by bottom panel sections 16 and **16*a*, and a vertical central panel 18. The central panel 18 divides the carton into separate adjacent sections in which the glasses G are contained. Carton C is in the form of an open ended sleeve, and each section contains two glasses which extend across the length of the sleeve between the open ends thereof. While the sections are shown as holding a row of two cylinders, it will be appreciated that the container could be made for the sections to hold a different number by varying the length of panels 10, 12, 14, 16 and 18. Preferably, panels 10, 12, 14 and 16 are of a length such that glasses G will extend beyond the end edges of the sleeve to provide maximum visible exposure thereof to consumers. In this respect, and as best seen in FIG. 5, the side panels 10 and 12 are joined to the top panel 14 along fold lines 20 and 22, respectively, and to the bottom panel portions 16 and 16*a* along fold lines 24 and 26, respectively. As will be appreciated from FIGS. 1 and 4, the panel widths at these fold lines are narrower than the combined diameters of the rows of glasses G contained in the carton sections so that sectors of the top and bottom edges of the glasses are exposed at the sides and ends of the carton. This provides the advantage of optimizing visibility of the glasses to consumers from all sides when the cartons are stacked for display and sale. Visibility of the glasses is further enhanced by the converging contours of side panels 10 and 12 between fold lines 20 and 24 and fold lines 22 and 26, respectively as best seen in FIGS. 1 and 5. Maximum exposure of glasses G at the top and bottom panel is obtained with these panels having edges diverging from the corresponding hinge lines across the ends of the glasses as best seen in FIG. 4**.

Figure 2:
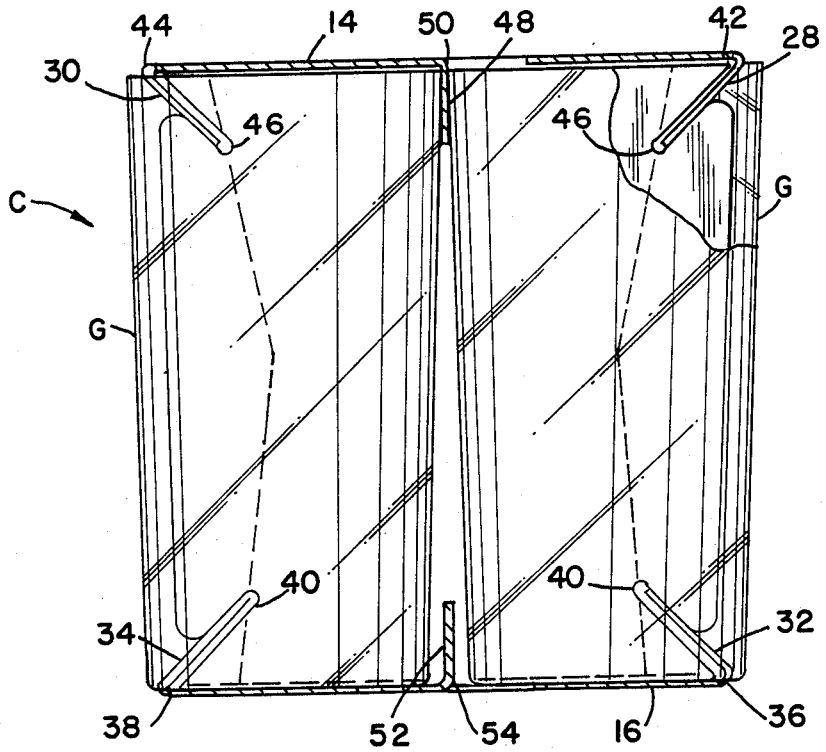
FIG. 2 is a cross sectional elevation view taken along line 2—2 in FIG. 1.

Locking tabs 28 and 30 are provided on laterally opposite sides of top panel 14, and locking tabs 32 and 34 are provided on laterally opposite sides of bottom panel portion 16. These tabs interlock with central panel 18 to retain glasses G within the open ends of the folded carton C. More particularly, lower tabs 32 and 34 will alone effectively retain the glasses, and upper tabs 28 and 30 preferably are included to provide greater retention of the glasses. The locking tabs are centrally located relative to the erected blank so as to be transverse to and symmetrical with respect to the plane of central panel 18. Tabs 32 and 34 are foldable at hinge lines 36 and 38, respectively, to rotate transverse to the plane of central panel 18 from the position shown in FIG. 5 into releasable locking engagement with central panel 18 as shown in FIGS. 1 and 2. For the latter purpose, a pair of upwardly and inwardly inclined slots 40 are formed in central panel 18 adjacent the bottom panel portions to receive tabs 32 and 34 in the locking position. When inserted into the slots 40, tabs 32 and 34 cooperate with side panels 10 and 12 to retain glasses G within the open ends of the closed carton C by blocking passage of the bottom ends of the glasses directly out of the corresponding carton section. Further, the tabs 32 and 34 are sufficiently rigid to resist twisting of the glasses out of a carton section. Tabs 28 and 30 at the top panel 14 are connected thereto by fold lines 42 and 44, respectively, and are received in and cooperate with the downwardly and inwardly inclined slots 46 in central panel 18 in a like manner.

Preferably, tabs 28, 30 and 34 have converging side edges and terminate in rounded inner ends. This facilitates introducing the tabs into their slots, and the small size of the tabs optimizes visibility while providing adequate retention of the glasses.

Of considerable importance in connection with the present invention is the manner in which the tabs 28, 30, 32 and 34 retain glasses or other cylindrical objects within the open carton ends without obstructing the visible exposure of the objects to retail consumers. In this respect, the width of the lower tabs 32 and 34 along fold lines 36 and 38 is just sufficient in cooperation with side walls 10 and 12 to effectively block passage of the objects out of the carton sections. The tabs are wide enough at the fold lines to retain the lowermost portion of the object, which may be tapered and narrowest at the bottom as shown in FIG. 3. Further, the tabs extend from their fold lines upwardly and inwardly between glasses G and are tapered and of a length which provides for the side edges thereof to effectively secure the cylinders against tipping out over the tabs. Upper tabs 28 and 30 are likewise formed to minimum widths along their fold lines are tapered and of a length to extend between the glasses and to cooperate in the same manner with side walls 10 and 12 to retain the upper ends of the glasses in the carton. Additionally, the tapered and rounded shape of the tabs and the length thereof transverse to their fold lines permits placement of the tabs within the slots provided therefor such that the tabs can angularly extend between the glasses without spacing them apart. This provides the additional advantage of maintaining the closest array of objects, and consequently providing the smallest container for objects of a given size.

In accordance with another aspect of the invention, carton C includes finger hole tabs 48 in top panel 14 which provide corresponding finger tab holes for lifting and carrying the carton. Finger hole tabs 48 are formed in top panel 14 to fold along a hinge line 50, whereby the tabs are foldable inwardly of top panel 14 to provide corresponding finger holes. Advantageously, the hinge lines are coincident with the central axis of top panel 14 between side panels 10 and 12 so that the tabs are foldable into a vertical position between adjacent glasses G contained in the carton sections. Thus, tabs 48 provide both finger openings for carrying the carton C and spacer elements to prevent direct contact between the glasses in the corresponding carton section. Preferably, similar tabs 52 foldable about hinge lines 54 are provided in the bottom panel portions 16 and **16*a* to extend upwardly between adjacent glasses G as shown in FIGS. 1–4**.

Figure 6:
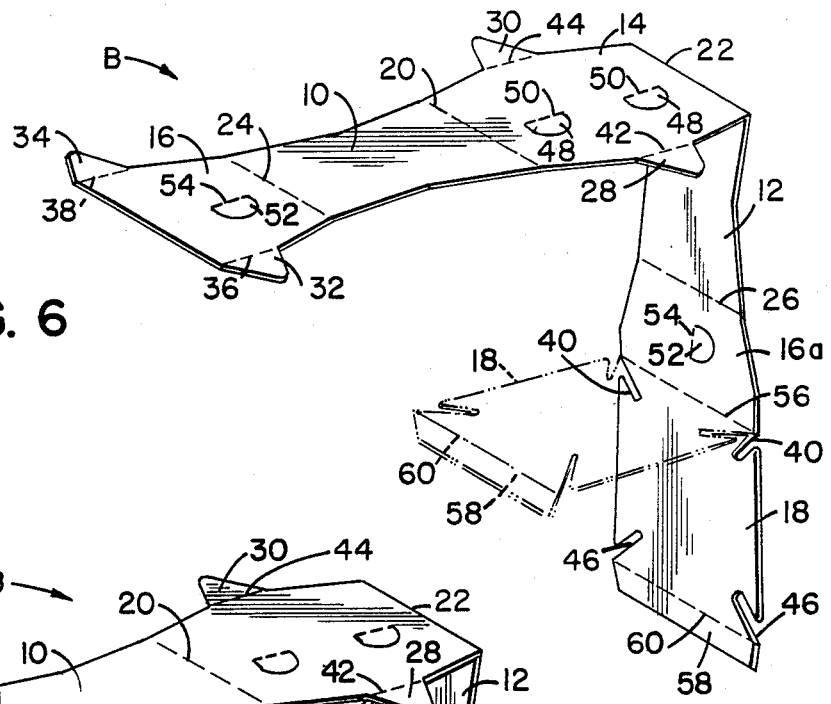
FIGS. 6–8 are perspective views showing the sequence of folding of the blank to form the carton shown in FIG. 1.
Figure 7:
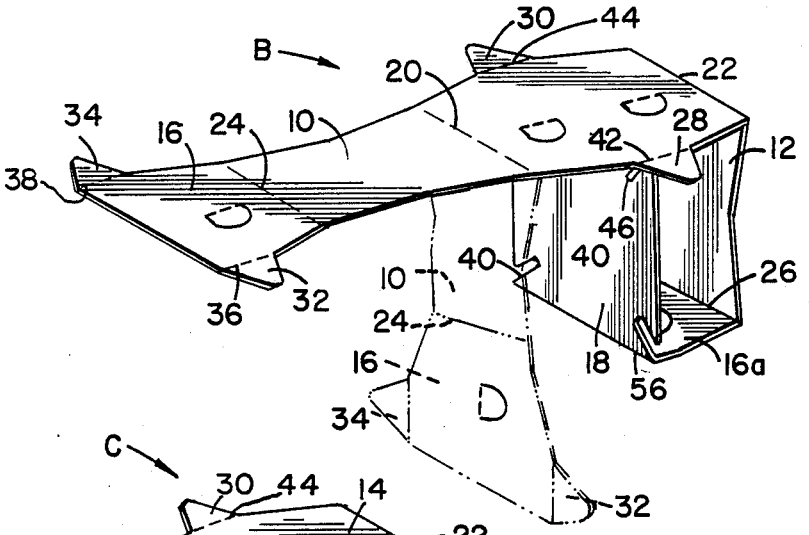
Figure 8:
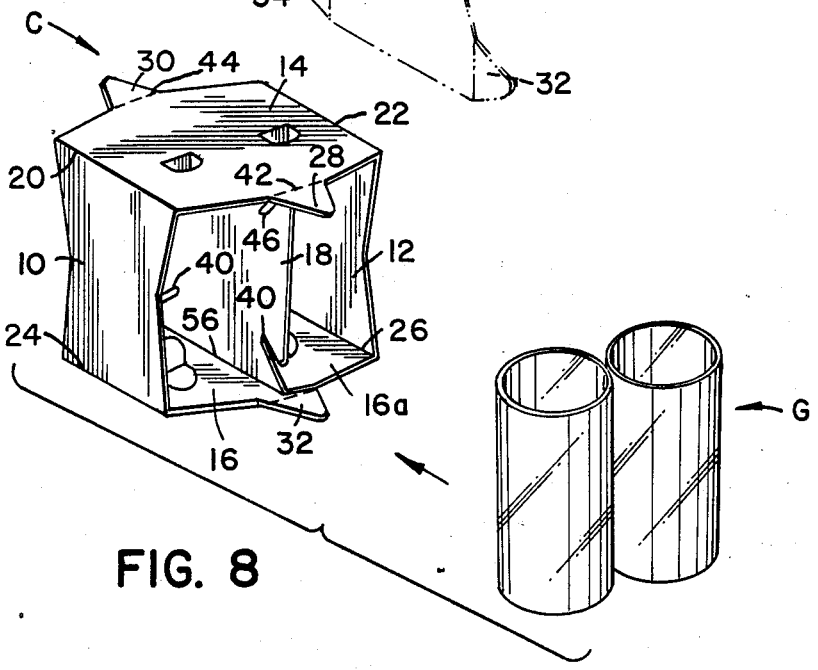

With reference to FIG. 5, blank B further includes a fold line 56 between central panel 18 and bottom panel section **16*a*, and an extension flap 58 on the end of panel 18 and joined therewith along a fold line 60. The erection of blank B to form container C is illustrated in FIGS. 6–8 and will be understood from the following description with respect to these figures. With reference first to FIG. 6, blank B is folded about fold line 22 and thence about fold line 56 for top panel 14 and central panel 18 to be parallel to one another. Then, as will be seen from FIG. 7, the blank is folded about fold line 26 for bottom panel portion 16*a* to be parallel to top panel 14 and for central panel 18 to extend upwardly perpendicular to the top panel. At this point, extension flap 58 is folded along line 60 to underlie top panel 14 and is secured thereto such as by an adhesive. The blank is then folded along line 20 for side panel 10 to be parallel with central panel 18 and side panel 12. Then, as will be seen from FIG. 8, bottom panel portion 16 is folded about line 24 to extend parallel to top panel 14. When so folded, the marginal end edge of panel portion 16 underlies bottom panel portion 16*a* adjacent fold line 56 and is then secured thereto such as by an adhesive. Finger hole tabs 48 are then folded downwardly, and bottom tabs 54 are folded upwardly into the corresponding container section. Glasses G are then introduced into the opposite open ends of the container, and locking tabs 28, 30, 32 and 34 are folded about their respective fold lines and inserted into the corresponding one of the slots 40 and 46** to complete the erection and packaging procedure.

While considerable emphasis has been placed herein on the structure of the preferred embodiments of the carton C and blank B, it will be appreciated that many changes can be made therein without departing from the invention. For example, the panels and tabs of carton C can be provided with a blank configuration other than that shown in FIG. 5. More particularly in this respect, carton C could be erected from a blank in which central panel 18 is disposed centrally between the opposite ends of the blank, and in which a portion of the top panel, one of the side panels and a portion of the bottom panel of the carton are disposed sequentially between one end of the central panel and one of the opposite ends of the blank. Similarly, the other portion of the bottom panel, the other side panel and the other portion of the top panel would be disposed sequentially between the other end of the central panel and the other of the opposite ends of the blank. The locking tabs would extend laterally outwardly from the panel portions at the opposite ends of the blank, and the finger hole and bottom panel tabs would each be provided in a different one of the top and bottom panel portions. Such a blank configuration would be foldable to provide the carton configuration shown in FIG. 1 and would differ therefrom only in that both the top and bottom panels of the carton would be defined by overlapped and adhesively bonded panel portions with the central panel being integral with one of the top panel portions and one of the bottom panel portions. Additionally, while the locking tabs are preferably tapered and have rounded inner edges, it will be appreciated that the inner edges could be linear, whereby the tabs would have a trapezoidal configuration. These and other modifications will be suggested or obvious from the embodiment illustrated and described, whereby it is to be distinctly understood that the foregoing descriptive matter is to be interpreted merely as illustrative of the invention and not as a limitation.

Having thus described the invention, it is claimed:

1. In a folded packaging carton having a planar divider piece defining adjacent interior sections of said carton on opposite planar sides of said divider piece, and a carton panel generally perpendicular to said divider piece, the improvement comprising:

means for retaining packaged objects in said sections, said retaining means comprising a folding line extending partially across the surface of said carton panel and generally perpendicularly to the plane of said divider piece, a slot in said divider piece having an open end adjacent said folding line, and, a unitary flat planar tab component of said carton panel having edges extending from the ends of said folding line to a free tab end narrower than the length of said folding line, said tab component being pivotal about said folding line out of the plane of said carton panel into a folded position received in said slot with said tab component in said folded position having a flat planar configuration between said folding line and said free tab end.

2. The improvement of claim 1 wherein said tab edges are substantially linear.

3. The impovement of claim 1 wherein said tabs are trapezoidal.

* * * * *